US008624145B2

(12) United States Patent
Fleitmann et al.

(10) Patent No.: US 8,624,145 B2
(45) Date of Patent: Jan. 7, 2014

(54) INDICATOR DEVICE OF A CIRCUIT BREAKER

(75) Inventors: Gregor Fleitmann, Kerpen (DE); Volker Heins, Rheinbach (DE); Wolfgang Wagner, Neutraubling (DE)

(73) Assignee: Eaton Industries GmbH, Bonn (DE)

( * ) Notice: Subject to any disclaimer, the term of this patent is extended or adjusted under 35 U.S.C. 154(b) by 166 days.

(21) Appl. No.: 13/227,503

(22) Filed: Sep. 8, 2011

(65) Prior Publication Data

US 2012/0061224 A1 Mar. 15, 2012

(30) Foreign Application Priority Data

Sep. 9, 2010 (EP) ..... 10175979

(51) Int. Cl.
*H01H 5/00* (2006.01)

(52) U.S. Cl.
USPC ..... 200/400; 200/308; 335/17

(58) Field of Classification Search
USPC ..... 200/400, 308; 335/17
See application file for complete search history.

(56) References Cited

U.S. PATENT DOCUMENTS

| | | | | |
|---|---|---|---|---|
| 4,128,750 | A * | 12/1978 | Castonguay et al. | 200/308 |
| 4,166,989 | A * | 9/1979 | Castonguay et al. | 335/17 |
| 4,301,342 | A * | 11/1981 | Castonguay et al. | 200/400 |
| 4,301,433 | A * | 11/1981 | Castonguay et al. | 335/13 |
| 4,351,994 | A * | 9/1982 | Evans et al. | 200/400 |
| 6,005,208 | A * | 12/1999 | Castonguay | 200/308 |
| 6,130,390 | A | 10/2000 | Castonguay | |
| 7,906,740 | B2 * | 3/2011 | Gopikrishnan Babu et al. | 200/400 |
| 2002/0079207 | A1 | 6/2002 | Greenberg et al. | |
| 2012/0048695 | A1 * | 3/2012 | Liebetruth | 200/308 |

* cited by examiner

*Primary Examiner* — Vanessa Girardi
(74) *Attorney, Agent, or Firm* — Leydig, Voit & Mayer, Ltd.

(57) ABSTRACT

An indicator device displays a status of switching contacts of a circuit breaker that includes an energy store. The indicator device includes a lever and a coupling element. The lever includes a display element and is movable between a triggered position and a non-triggered position based upon at least one operational parameter. The coupling element is operatively connected to the lever so as to be movable between a triggered, position and a non-triggered position by the lever. The coupling element is configured to be further operatively connected to a first actuator of the energy store so as to be movable by the first actuator into the non-triggered position when energy is stored in the first energy store and so as to not be moved from the non-triggered position into the triggered position when energy stored in the energy store is released.

16 Claims, 6 Drawing Sheets

1

INDICATOR DEVICE OF A CIRCUIT BREAKER

CROSS REFERENCE TO RELATED APPLICATIONS

This application claims priority to European Patent Application No. EP 10 175 979.3, filed Sep. 9, 2010 which is hereby incorporated by reference herein in its entirety.

FIELD

The present invention relates to an indicator device for displaying the status of switching contacts of a circuit breaker and to a corresponding circuit breaker.

BACKGROUND

The display devices of certain circuit breakers can indicate the status "operative readiness" or "ok" when all requirements for operating a circuit breaker are fulfilled. These requirements are e.g. that the circuit breaker is switched off, the energy store is loaded, the circuit breaker is fully inserted in a framework, or the tripping unit is ready. If all these requirements are fulfilled, the circuit breaker is ready to operate and can be switched on. If one of the requirements is not fulfilled, the display will indicate a problem by displaying a non-operative-status. The operator does not get an indication, why the circuit breaker is not ready to operate. He has to check the circuit breaker to find the problem.

SUMMARY

In an embodiment, the present invention provides an indicator device for displaying a status of switching contacts of a circuit breaker that includes an energy store configured to store energy for passing over the switching contacts from a closed position to an opened position when stored energy in the energy store is released and a latching device for closing the switching contacts. The indicator device includes a lever and a coupling element. The lever includes a display element and is movable between a triggered position and a non-triggered position based upon at least one operational parameter. The coupling element is operatively connected to the lever so as to be movable between a triggered position and a non-triggered position by the lever. The coupling element is configured to be further operatively connected to a first actuator of the energy store so as to be movable by the first actuator into the non-triggered position when energy is stored in the first energy store and so as to not be moved from the non-triggered position into the triggered position when energy stored in the energy store is released.

BRIEF DESCRIPTION OF THE DRAWINGS

Exemplary embodiments of the present invention are described in more detail below with reference to the drawings, in which.

DETAILED DESCRIPTION

Figure 1:
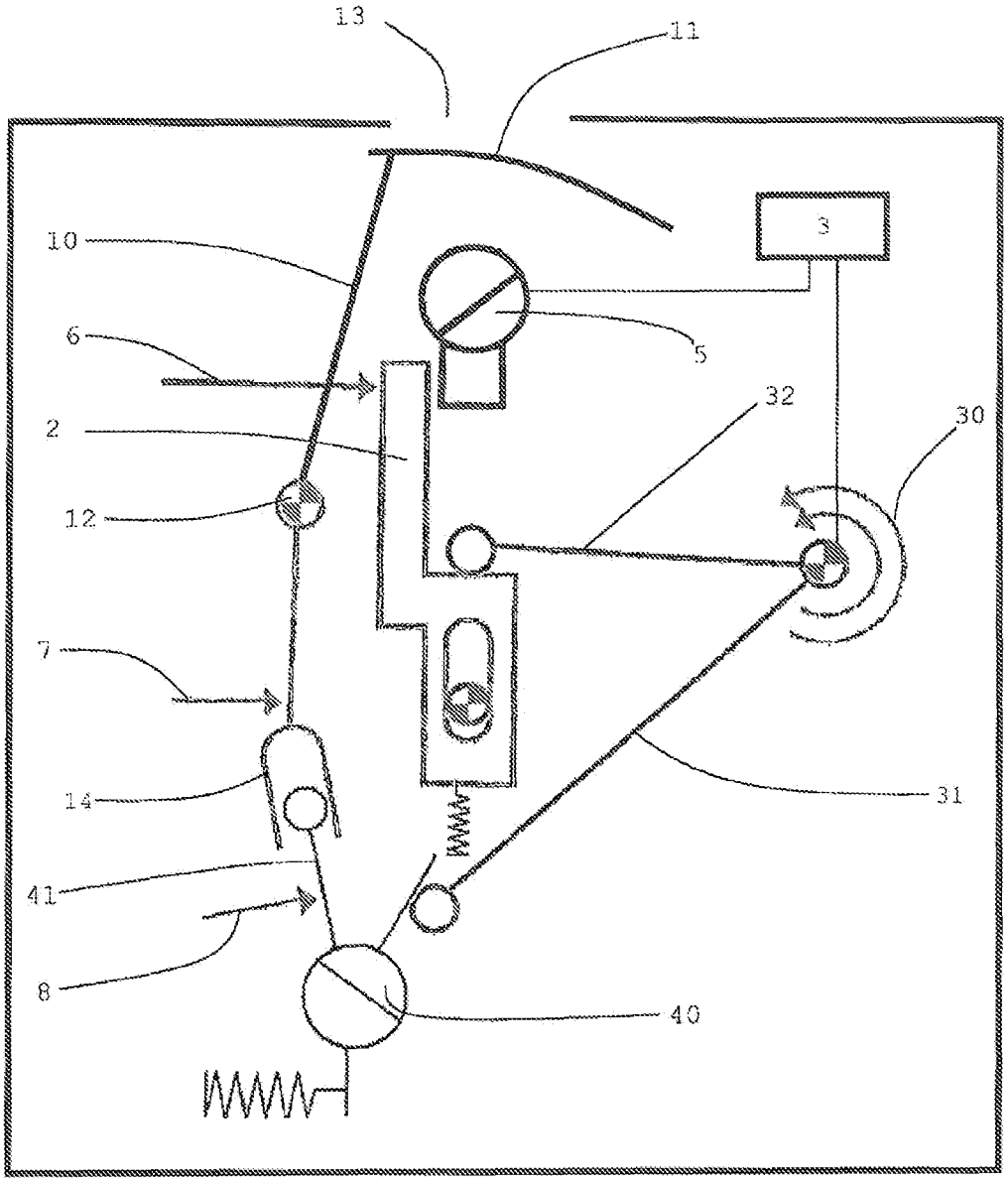
FIG. 1 is a schematic depiction of an embodiment of an indicator device in an operation readiness status.

In an embodiment, the present invention provides an indicator device that improves the status display of a circuit breaker.

In an embodiment the present invention provides an indicator device for displaying the status of switching contacts of a circuit breaker. The circuit breaker comprises an energy store to store energy for to pass over the switching contacts from a closed position into an opened position when the energy stored in the energy store is released. Further the circuit breaker comprises a latching device for closing the switching contacts. The indicator device comprises a lever with a display element, wherein the lever is moveable between a triggered position and a non-triggered position in dependence upon at least one operational parameter. Further the indicator device comprises a coupling element which is operatively connected to the lever such that the coupling element is movable between a triggered position and a non-triggered position by the lever. The coupling element is further operatively connected to a first actuator of the energy store such that if the energy is stored in the energy store, the first actuator moves the coupling element into the non-triggered position and wherein a release of the energy stored in the energy store does not move the coupling element from the non-triggered position into the triggered position. It is therefore possible to indicate a special status to an operator. If the lever moved into the triggered position when an operational parameter triggers the lever the display element indicates the status triggered. If the stored energy is released by other circumstances like high current, the coupling element will not move the lever in the triggered position. A further display element can be used to indicate this situation.

In an embodiment the indicator device comprises a slider which is moved by a second actuator of the energy store into a block position to block the latching device when the stored energy is released. The circuit breaker cannot be switched on when a problem still occurs.

In an embodiment, the energy store is a spring-operating storage. A spring is a simple and cost-effective energy store.

In an embodiment the operational parameter is a trigger from a shunt release and/or from an undervoltage release. A shunt release or an undervoltage release can be assigned to the circuit breaker as an additional device. The shunt release or shunt trip triggers the circuit breaker to release the main contacts if a current above a specified level occurs. The undervoltage release triggers the circuit breaker in case of an undervoltage-situation. It is also possible that both releases (shunt and undervoltage) can be assigned together to the circuit breaker to monitor the current and voltage of the main circuits. In an embodiment, the coupling element is triggered by an electronic release to move into the triggered position. An electronic release comprises additional electronic circuits and also monitors the current or voltage of the main circuits, but also other parameters can be monitored by an electronic release using e.g. current transformers or thermal sensors. The displayed status makes a troubleshooting easier, since the status itself is not visible from the outside of the switch, especially when displaying an undervoltage release or an operating current release.

In an embodiment the circuit breaker is removably arranged in a framework and the coupling element is triggered to move into the triggered position when the circuit breaker is removed from the framework. This embodiment avoids switching on a circuit breaker which is not fully inserted into the framework. If the contact plugs are not fully inserted, a sparkover between different phases can occur when the current flows.

In an embodiment the coupling element is triggered by a closing mechanism of the circuit breaker to move into the triggered position. A closing mechanism locks the circuit breaker so that it cannot be turned on.

In an embodiment the coupling element does not move the lever into the triggered position when the coupling element is triggered. The coupling element can be triggered by several inputs as described in the above mentioned embodiments. If the display element should only indicate a trigger from a shunt release or an undercurrent release, the coupling element must prevent the display element from moving into another position, if a trigger from another source (electronic release, etc.) occurs.

In an embodiment, the present invention also provides a circuit breaker with an energy store to store energy for to pass over the switching contacts from a closed position into an opened position when the energy stored in the energy store is released and a latching device for closing the switching contacts. The circuit breaker comprises an indicator device according to any of the prescribed embodiments.

FIG. 1 depicts a schematic depiction of a first embodiment of an indicator device in an operation readiness status. The indicator device comprises a lever 10 and a display device 11, The display device 11 is fastened at one end of the lever 10. The display device 11 indicates the status of the switching contacts 3 of a circuit breaker 1 to an operator. Therefore, symbols and/or text can be printed on the display device 11. The lever 10 is rotatably mounted on a pivot 12, if the lever 10 rotates, the display device 11 moves under a display window 13 of the circuit breaker 1 and indicates other information to the operator. The lever 10 is coupled to a coupling element 40. The coupling element 40 is rotatably mounted on the circuit breaker such that if the lever 10 rotates on its pivot 12, the coupling element 40 rotates. To couple the coupling element 40 with the lever 10, the coupling element 40 comprises a crank 41 which is movably arranged in an acceptance 14 of the lever 10. The U-formed acceptance 14 in this embodiment is able to move the crank 41 in two directions. If the lever 10 rotates clockwise or counterclockwise, it moves also the coupling element 40 in the opposite directions.

The lever 10 can be moved by an external trigger 7, which can be a trigger from a shunt release or an undervoltage release. The trigger 7 is a force which can be transferred from the shunt/undervoltage release to the lever 10 by mechanical means. If the shunt release detects an overcurrent or the undervoltage release detects an undervoltage, it triggers 7 the lever 10 to move.

Another trigger 8 at the crank 41 moves the coupling element 40 in a position such that it also moves the lever 10 in the non-readiness position. The second trigger 8 comes e.g. from an electronic release, a closing mechanism or from an indicator that indicates that the circuit breaker is not correctly inserted into a framework.

Figure 2:
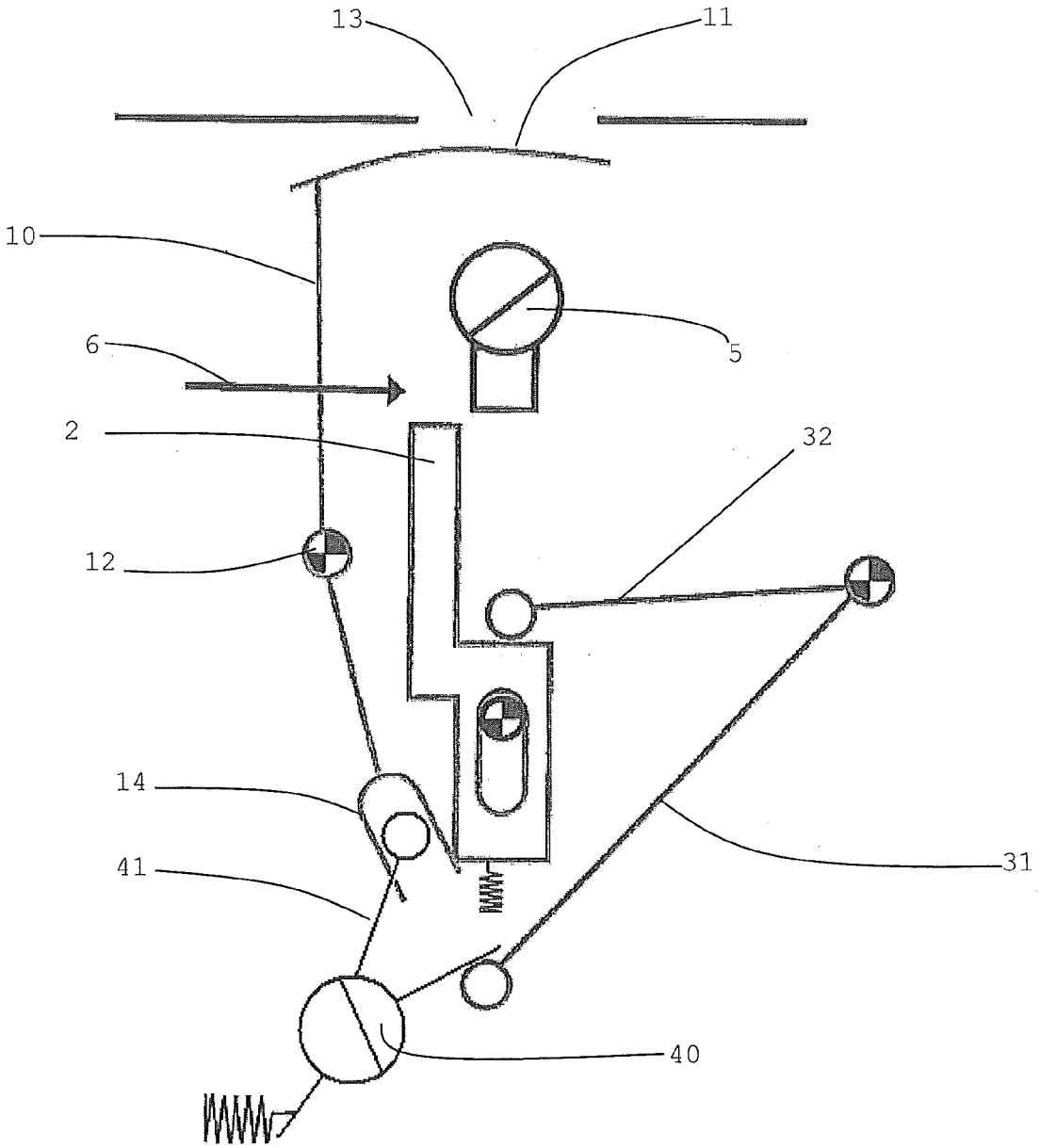
FIG. 2 is a schematic depiction of an embodiment of an indicator device in an operation not readiness status.
Figure 3:
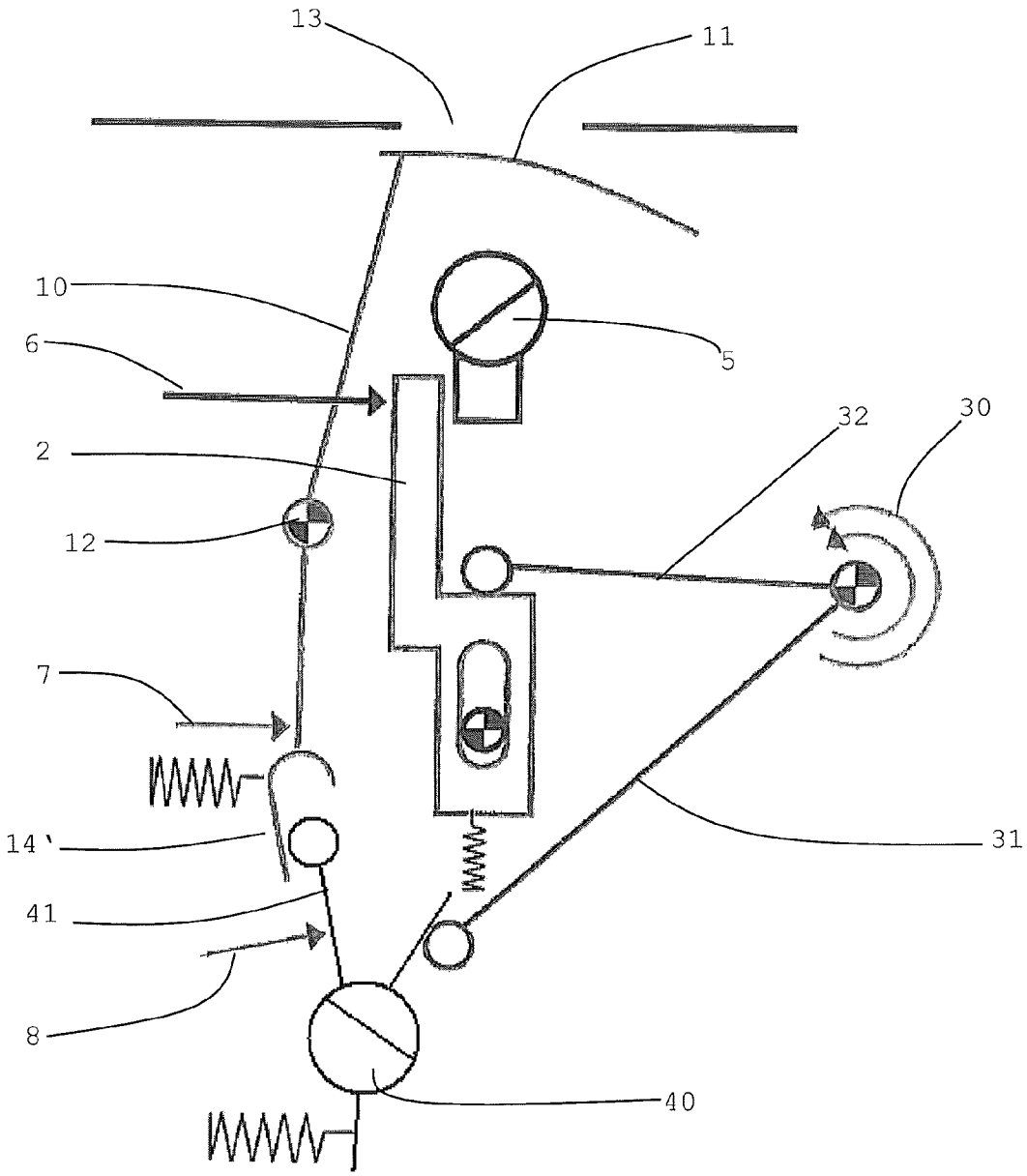
FIG. 3 is a schematic depiction of an embodiment of an indicator device in a non-triggered by shunt release status.

FIG. 2 depicts the situation when the lever 10 and the coupling element 40 are moved in a second position. After the lever 10 is moved to a second position, the display element 11 indicates to the operator through the display window 13 that the circuit breaker is not ready to operate because of an external trigger.

The coupling element 40 is further coupled to a first actuator 31 which is operatively connected to an energy store 30. If the first actuator 31 is moved by the coupling element 40, the energy stored in the energy store 30 is released and the switching contacts of the circuit breaker open. A second actuator 32 of the energy store 30 is operatively connected to a slider 2. The slider 2 is adapted to block or to let pass the switch-on force 6 for a latching device 5. If the slider 2 is moved to a first position according FIG. 1, an external mechanical mechanism can switch-on a latching device 5 which closes the switching contacts of the circuit breaker by mechanical means. If the slider 2 is moved back into a second position according FIG. 2, the switch-on force 6 cannot be transferred to the latching device 5. It is therefore not possible to switch on the circuit breaker, if no energy is stored in the energy store 30 and the switching contacts are open. After energy is reloaded into the energy store, both actuators 31, 32 are moved back to the positions according FIG. 1. A spring force moves the slider 2 back to the first position to enable the switch-on force 6 to switch on the circuit breaker by the latching device 5.

If the energy stored in the energy store 30 is released by other means, it cannot move the coupling device 40 into the second position according FIG. 2 because the coupling is only workable in one direction. This means that only the coupling device 40 is able to move the first actuator 31 of the energy store 30. The first actuator 31 cannot move the coupling device 40, because there is no mechanical area of contact available.

FIGS. 3 to 6 disclose a second embodiment of the invention. The difference between the first and the second embodiment is that the coupling element 40 is coupled to the lever 10 in a different way. The crank 41 is not able to move the acceptance 14' and the lever 10 to the non-readiness position because the second area of contact in the acceptance 14' is missing. Therefore, only the trigger 7 moves the lever 10 and the display element 13 to a second position which indicates now the release of a shunt or undervoltage release. It is possible to mount the embodiment of FIGS. 1 and 2 and the embodiment of FIGS. 3 to 6 in parallel such that the operator is informed by two display elements 13.

Figure 4:
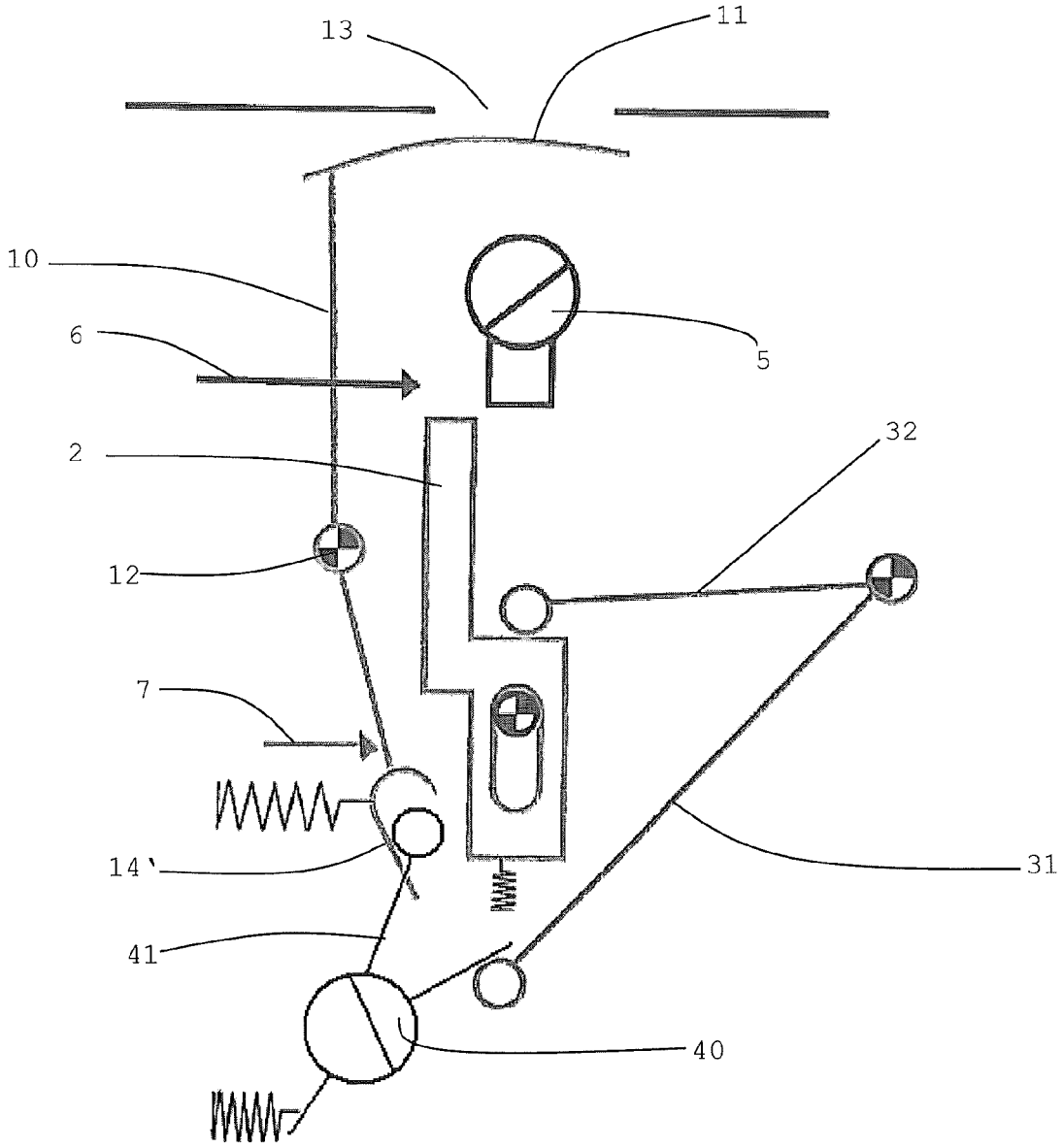
FIG. 4 is a schematic depiction of an embodiment of an indicator device in a triggered by shunt release status.

FIG. 4 depicts the situation that an overcurrent or undervoltage situation triggers 7 the lever 10 to display the status that an undervoltage or overcurrent situation is detected by the overcurrent or undervoltage release. The energy stored in the energy store 30 is released such that the switching contacts are open. The slider 2 is moved into the block position such that the latching device 5 cannot be activated by the switch-on force 6 to close the switching contacts.

Figure 5:
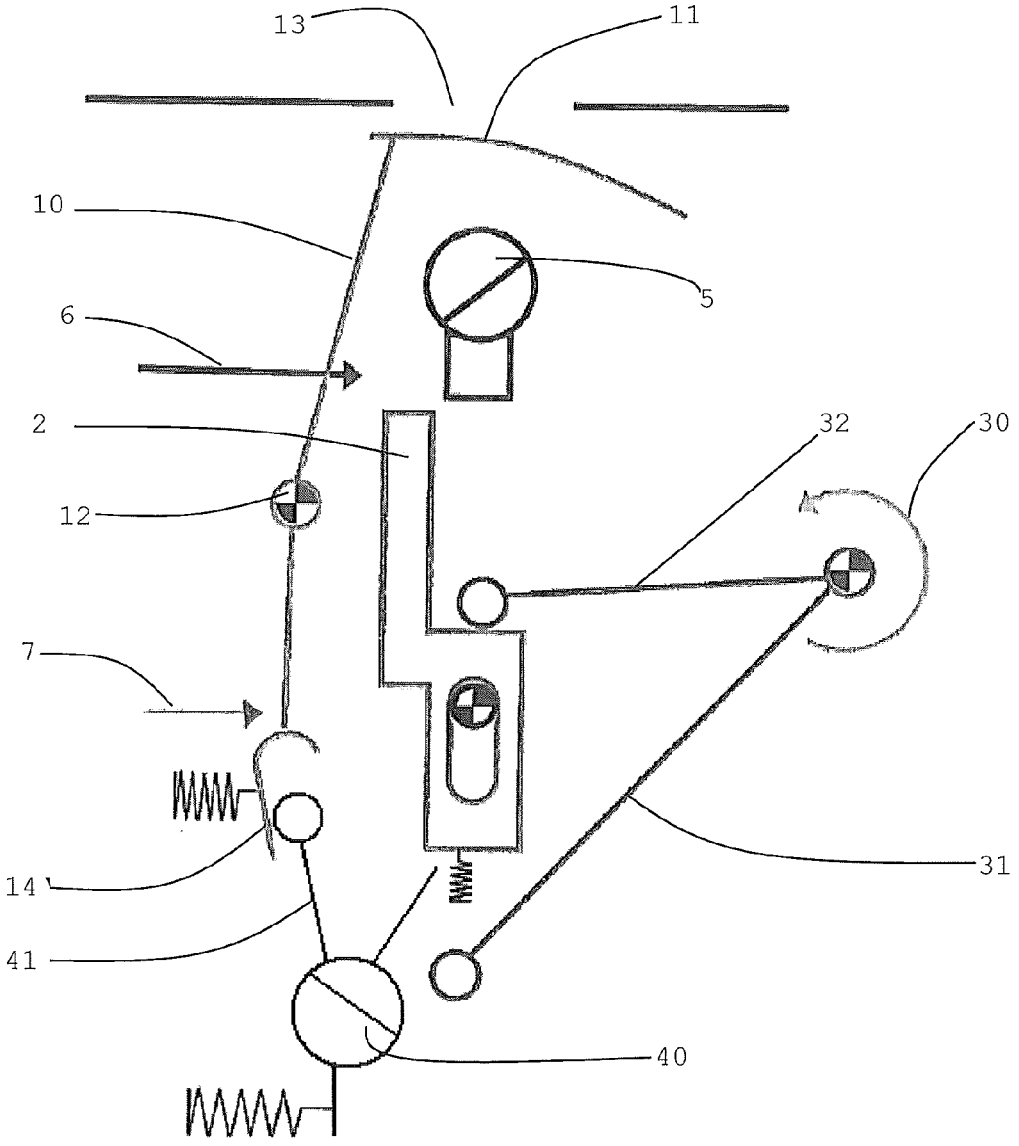
FIG. 5 is a schematic depiction of an embodiment of an indicator device in a non-triggered by shunt release status, wherein the energy store was released, FIG. 6 a schematic depiction of an embodiment of an indicator device in a non-triggered by shunt release status, wherein the circuit breaker was triggered by an electronic release.

FIG. 5 depicts the situation that the energy stored in the energy store 30 is released without getting a trigger 7, 8 from the external releases. The lever 10 and the display device 13 remains in the position no undervoltage/overcurrent release. The operator can now narrow the analysis of error.

Figure 6:
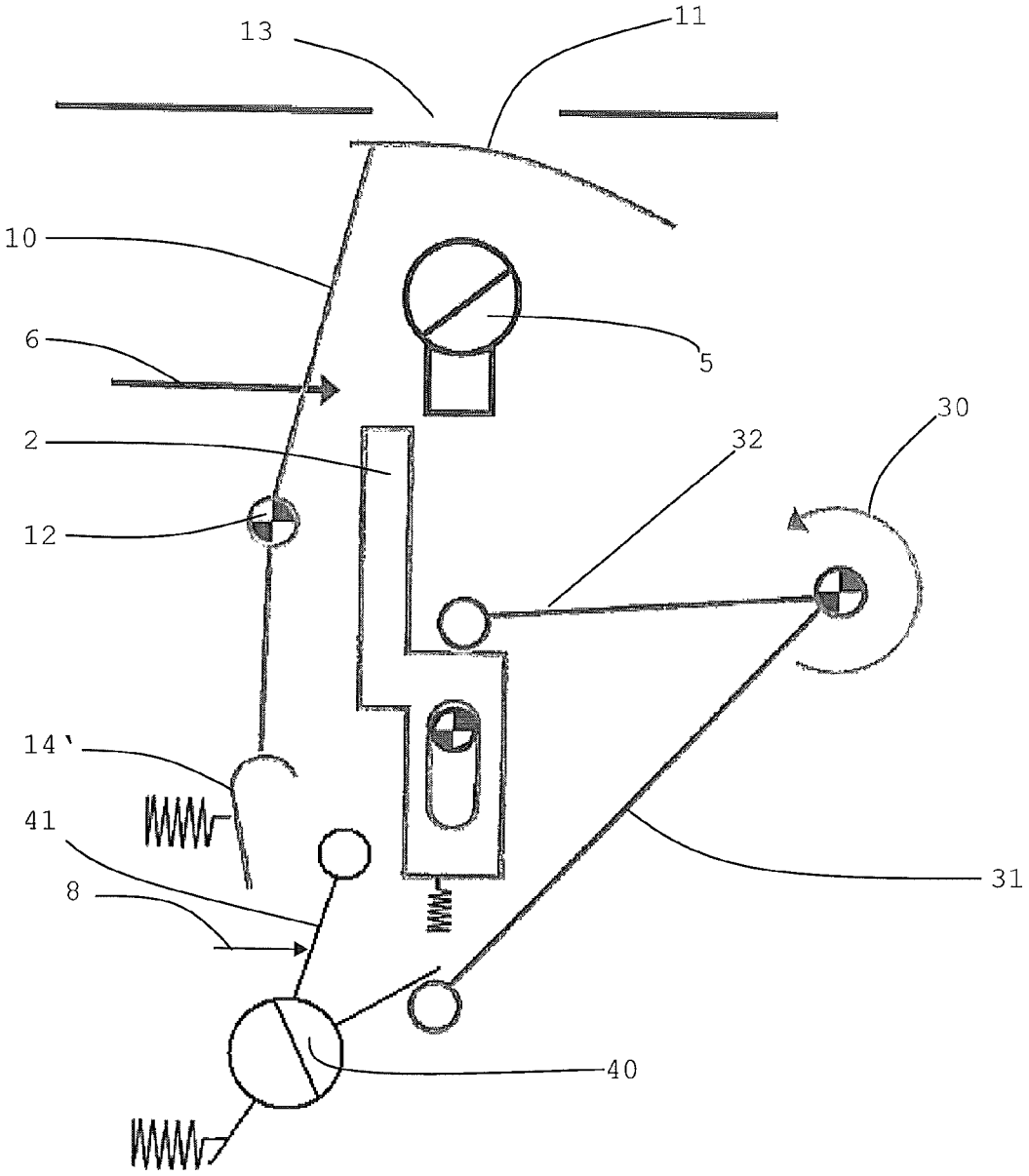

FIG. 6 depicts the situation that an electronic release, a closing mechanism or an indicator that indicates that the circuit breaker is not correctly inserted into a framework triggers 8 the coupling mechanism 40. The coupling element 40 moves the first actuator 31 to release the energy stored in the energy store 30 to open the switching contacts of the circuit breaker. The coupling element 40 does not move the lever 10 and the display device 13. The display device 13 indicates that there is no trigger 7 from an undervoltage or overcurrent release.

While the invention has been particularly shown and described with reference to preferred embodiments thereof, it will be understood by those skilled in the art that various changes in form and details may be made therein without departing from the spirit and scope of the invention.

REFERENCE NUMERALS

1 circuit breaker
3 switching contacts
10 lever
11 display element
12 pivot
13 display window
14, 14' acceptance
2 slider
30 energy store
31 first actuator
32 second actuator
40 coupling element
41 crank
5 latching device
6 switch-on force
7 trigger (operational parameter)
8 trigger (electronic release, closing mechanism)

What is claimed is:

1. An indicator device for displaying a status of switching contacts of a circuit breaker that includes an energy store configured to store energy for passing over the switching contacts from a closed position to an opened position when stored energy in the energy store is released and a latching device for closing the switching contacts, the indicator device comprising:

a lever including a display element, the lever being movable between a triggered position and a non-triggered position based upon at least one operational parameter; and a coupling element operatively connected to the lever so as to be movable between a triggered position and a non-triggered position by the lever, the coupling element being configured to be further operatively connected to a first actuator of the energy store so as to be movable by the first actuator into the non-triggered position when energy is stored in the first energy store and so as to not be moved from the non-triggered position into the triggered position when energy stored in the energy store is released.

2. The indicator device recited in claim 1, wherein the indicator device includes a slider that is movable by a second actuator of the energy store into a block position so as to block the latching device when the energy stored in the energy store is released.

3. The indicator device recited in claim 1, wherein the energy store is a spring-operating storage.

4. The indicator device recited in claim 1, wherein the operational parameter is a trigger from at least one of a shunt release and an undervoltage release.

5. The indicator device recited in claim 1, wherein the coupling element is configured to be triggered by an electronic release so as to move into the triggered position.

6. The indicator device recited in claim 1, wherein the circuit breaker is removable from a framework and the coupling element is configured to be triggered so as to move into the triggered position when the circuit breaker is removed from the framework.

7. The indicator device recited in claim 1, wherein the coupling element is configured to be triggered by a closing mechanism of the circuit breaker so as to move into the triggered position.

8. An indicator device for displaying a status of switching contacts of a circuit breaker that includes an energy store configured to store energy for passing over the switching contacts from a closed position to an opened position when stored energy in the energy store is released and a latching device for closing the switching contacts, the indicator device comprising:

a lever including a display element, the lever being movable between a triggered position and a non-triggered position based upon at least one operational parameter; and a coupling element operatively connected to the lever so as to be movable between triggered position and a non-triggered position by the lever, the coupling element being configured to be further operatively connected to a first actuator of the energy store so as to be movable by the first actuator into the non-triggered position when energy is stored in the first energy store and so as to not be moved from the non-triggered position into the triggered position when energy stored in the energy store is released, wherein the coupling element is configured to be triggered by an electronic release so as to move into the triggered position, and wherein the coupling element is configured so as to not move the lever into the triggered position when the coupling clement is triggered.

9. A circuit breaker comprising:

an energy store configured to store energy for passing over switching contacts from a closed position into an opened position when energy stored in the energy store is released;

a latching device for closing the switching contacts; and an indicator device including:

a lever including a display element, the lever being movable between a triggered position and a non-triggered position based upon at least one operational parameter; and a coupling element operatively connected to the lever so as to be movable between a triggered position and a non-triggered position by the lever, the coupling element being further operatively connected to a first actuator of the energy store so as to be movable by the first actuator into the non-triggered position when energy is stored in the first energy store and so as to not be moved from the non-triggered position into the triggered position when energy stored in the energy store is released.

10. The circuit breaker recited in claim 9, wherein the indicator device includes a slider that is movable by a second actuator of the energy store into a block position so as to block the latching device when the energy stored in the energy store is released.

11. The circuit breaker recited in claim 9, wherein the energy store is a spring-operating storage.

12. The circuit breaker recited in claim 9, wherein the operational parameter is a trigger from at least one of a shunt release and an undervoltage release.

13. The circuit breaker recited in claim 9, wherein the coupling element is configured to be triggered by an electronic release so as to move into the triggered position.

14. The circuit breaker recited in claim 9, wherein the circuit breaker is removable from a framework and the coupling element is configured to be triggered so as to move into the triggered position when the circuit breaker is removed from the framework.

15. The circuit breaker recited in claim 9, wherein the coupling element is configured to be triggered by a closing mechanism of the circuit breaker so as to move into the triggered position.

16. The circuit breaker recited in claim 13, wherein the coupling element is configured so as to not move the lever into the triggered position when the coupling element is triggered.

* * * * *